United States Patent [19]

Sutton, Jr.

[11] Patent Number: 4,516,766

[45] Date of Patent: May 14, 1985

[54] RESILIENT SUPPORT FOR PLAYGROUND SEAT

[75] Inventor: Wesley D. Sutton, Jr., Fort Payne, Ala.

[73] Assignee: Game Time, Inc., Fort Payne, Ala.

[21] Appl. No.: 628,968

[22] Filed: Jul. 11, 1984

Related U.S. Application Data

[63] Continuation of Ser. No. 469,804, Feb. 25, 1983, abandoned.

[51] Int. Cl.[3] ..... A63G 17/00

[52] U.S. Cl. ..... 272/52; 248/634; 267/63 R; 297/181

[58] Field of Search ..... 272/52, 52.5, 53.1, 272/53.2, 51, 110, 1 R; 267/21 R, 63 R, 63 A, 152, 153, 57.1 R, 57.1 A; 248/560, 599, 608, 609, 632, 622, 634; 297/181, 208

[56] References Cited

U.S. PATENT DOCUMENTS

| | | | |
|---|---|---|---|
| 2,231,769 | 2/1941 | Merrill | 267/153 X |
| 2,758,832 | 8/1956 | Hickman | 267/63 A |
| 2,797,916 | 7/1957 | Pellarini et al. | 267/63 R X |
| 3,007,692 | 11/1961 | Kniffin, Jr. | 267/63 R X |
| 3,078,479 | 2/1963 | Grosse et al. | 272/52 X |
| 3,204,953 | 9/1965 | Ahrens | 272/52 |
| 3,675,919 | 7/1972 | Ewers | 272/52 X |

FOREIGN PATENT DOCUMENTS

| | | | |
|---|---|---|---|
| 144865 | 11/1980 | German Democratic Rep. | 272/110 |
| 616457 | 1/1949 | United Kingdom | 267/63 A |
| 948176 | 1/1964 | United Kingdom | 267/152 |

OTHER PUBLICATIONS

SAE Journal, Nov., 1946, p. 32, Plate Sandwich Spring.

*Primary Examiner*—Robert A. Hafer
*Assistant Examiner*—Arnold W. Kramer
*Attorney, Agent, or Firm*—Lalos, Leeds, Keegan, Lett, Marsh, Bentzen & Kaye

[57] ABSTRACT

A rocking seat for children's amusement generally consisting of a seat assembly mounted on a base assembly securable to a support surface. The base assembly includes a body of resilient rubber material and has an overhanging portion that enhances the rocking motion of the seat assembly when a child seated in the seat assembly rocks back and forth. The body further has upper and lower flanges and a web portion interconnecting the flanges providing for a 360° rocking movement.

17 Claims, 3 Drawing Figures

RESILIENT SUPPORT FOR PLAYGROUND SEAT

This application is a continuation, of application Ser. No. 469,804, filed 2/25/83, and now abandoned.

This invention relates to park and playground equipment and more particularly to a rocking seat equipment.

In the prior art, a variety of rocking seats used as playground equipment have been developed. The rocking seats typically, and very basically, comprise a seat assembly adapted to hold a child, a base assembly on top of which the seat assembly is mounted, and a mounting assembly for mounting a lower portion of the base assembly to a support structure. The base assembly was formed of a material which allows for a rocking motion of the seat assembly relative to the support structure. Large coil springs have been used in some prior art rocking seats to provide the rocking motion. Rubber base assemblies have also been used, but because of their designs these rubber base assemblies in the past have only provided a back-and-forth rocking motion. This limited motion is not as enjoyable for and does not ignite the imagination of the children as would a 360° rocking motion which has previously not been available.

Accordingly, it is the principal object of this invention to provide a novel piece of park and playground equipment.

Another object of the present invention is to provide a novel piece of rocking seat playground equipment.

A further object of the present invention is to provide a novel and improved base assembly for supporting a seat assembly for a rocking seat.

A still further object of the present invention is to provide a novel rocking seat which is movable in any horizontal direction thereby challenging the user's imagination.

Another object of the present invention is to provide a novel "spring" assembly for a children's rocking seat which is flexible enough to provide a lot of motion thereby providing more enjoyment for the children using it.

A further object of the present invention is to provide a novel rubber spring assembly which gives the rocking seat 360° rocking movement capability.

A still further object of the present invention is to provide a novel rocking seat which is tough, durable and easy to assemble and disassemble.

Other objects and advantages of the present invention will become more apparent to those persons having ordinary skill in the art to which the present invention pertains from the following description taken in conjunction with the accompanying drawings, wherein.

Figure 1:
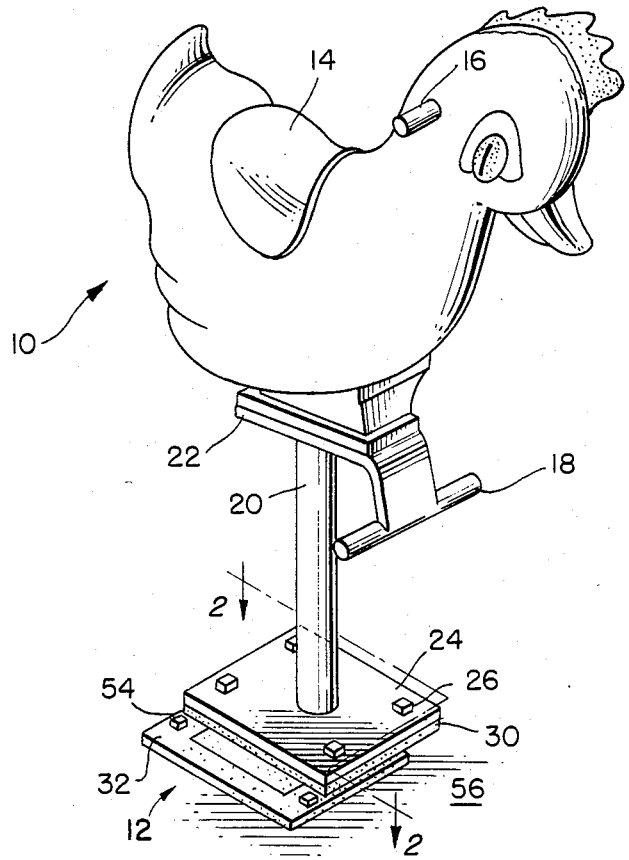
FIG. 1 is a perspective view of the preferred embodiment of the invention.

Referring to FIG. 1, an embodiment of the present invention is illustrated. It, generally, comprises a seat assembly shown generally at 10 mounted on top of a base assembly shown generally at 12. Seat assembly 10 includes a seat 14 generally configured to support a child, handlebars 16 positioned to be easily reached by a child seated in seat 14 and footrests 18 also positioned to be easily reached by the foot of a child sitting on seat 14. The seat assembly can be configured to assume the appearance of, for example, an animal or a vehicle. A bird is illustrated in the embodiment of FIG. 1, but horses and cars have also proven popular with children. These different animated forms, in addition to being aesthetically appealing, can also spark the child's immagination as he pretends to be riding on a horse or in a racing car, for example, as he rocks back and forth, or side to side.

Seat assembly 10 further includes a connecting member 20 which can comprise a structural member rigidly secured to its upper surface to the seat and secured to the base assembly by bolts 26 or any other suitable fastening means.

Figure 2:
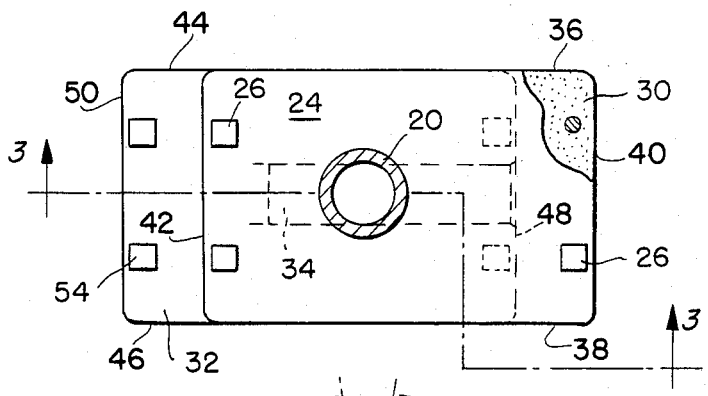
FIG. 2 is an enlarged cross sectional view taken along line 2—2 in FIG. 1.
Figure 3:
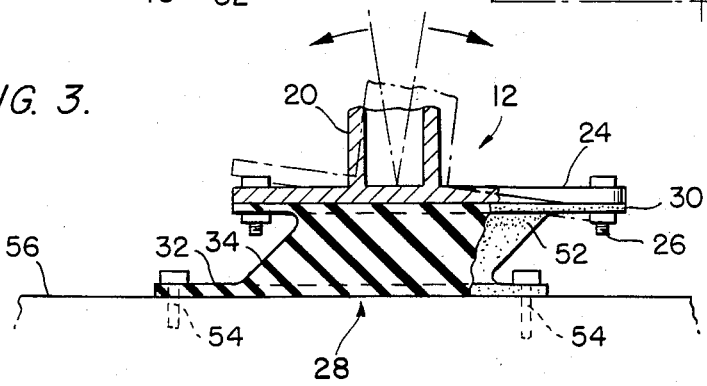
FIG. 3 is a cross sectional view taken along line 3—3 in FIG. 2.

Referring to FIGS. 2 and 3, the base assembly is best illustrated. It principally comprises a body of resilient material shown generally at 28. This body of material in the preferred embodiment comprises a 33±2.5 Shore A Durameter natural rubber. Body 28 is configured to have an upper flange 30, a lower flange 32 and a connecting web 34 connecting the upper and lower flanges. Upper flange 30 has a generally rectangular shape with sides 36 and 38, front edge 40 and rear edge 42. Lower flange 32 similarly has a rectangular shape with sides 44 and 46, front edge 48 and rear edge 50. As well shown in the FIGS. 2 and 3, front edge 40 is disposed ahead of front edge 48 and rear edge 42 is similarly disposed in front of rear edge 50. This offset positioning of the upper and lower flanges provides an overhanging portion for the body shown generally at 52. This enhances the rocking motion of the seat assembly when a child seated in the seat rocks forward and rearward. As described earlier, bolts 26 secure plate 24 to upper flange 30. A similar set of bolts 54 secure lower flange 32 to support structure 56. Support structure 56 can be any suitable type of support structure, for example concrete, firmly embedded in the ground.

It should be further noted that the present invention provides for ease in assembly and disassembly. By unbolting bolts 26 and 54, body 34 can be removed and readily replaced if worn or damaged. It is further noted that by bolting bolts 54 into support structure 56 the assembled invention is securely supported for safe rocking motion.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof as limited solely by the appended claims.

I claim:

1. A rocking seat for children's amusement positionable on a support surface comprising:

a seat assembly adapted to seat a child, an upright means comprising a generally vertically disposed pole having an upper end secured to said seat assembly and having a lower end, a body of resilient material having an upper surface, positioned generally below said seat assembly, and supporting said seat assembly, a retaining means for retaining and securing said lower end on and generally above said upper surface of said body of resilient material, said body of resilient material including an upper flange formed of resilient material to which said retaining means is attached, a lower flange formed of resilient material parallel to and spaced below said upper flange, and a web portion formed of resilient material interconnecting said upper flange and said lower flange, a securing means for securing said lower flange of resilient material to the support surface, and said body being configured to enhance the rocking motion between said lower end and the support surface as a child seated in said seat assembly shifts his weight forwardly and rearwardly and side to side, and said body of resilient material including a forward overhanging portion formed of resilient material and adapted to enhance said rocking motion.

2. The rocking seat of claim 1 including, said body having an inclined front surface.

3. The rocking seat of claim 1 including, said resilient material being rubber.

4. The rocking seat of claim 3 including, said being 33±2.5 points Shore A Durometer natural rubber.

5. The rocking seat of claim 4 including, said body having an inclined rear surface generally parallel to said front surface.

6. The rocking seat of claim 1 including, said upper flange having a front edge and a generally parallel rear edge, said lower flange having a front edge and a generally parallel rear edge, said upper flange front edge being disposed forward of said lower flange front edge, and said upper flange rear edge being disposed forward of said lower flange rear edge.

7. The rocking seat of claim 1 including, said web portion having an inclined front surface and a parallel inclined rear surface.

8. The rocking seat of claim 1 including, said body having a rhombodial cross-sectional configuration taken along a first vertical longitudinally disposed plane.

9. The rocking seat of claim 8 including, said body having a "I"-shaped configuration taken along a second vertical longitudinally disposed plane perpendicular to said first vertical longitudinally disposed plane.

10. The rocking seat of claim 1 including, said web portion having a width narrower than the width of said upper flange and of said lower flange.

11. The rocking seat of claim 1 including, said upper flange, said web portion, and said lower flange forming a continuous piece of resilient material.

12. The rocking seat of claim 1 including, said retaining means including a horizontal base plate, and a mounting means for mounting said base plate on and to said upper flange.

13. The rocking seat of claim 1 including, said resilient material being 33±2.5 points Shore A Durometer natural rubber.

14. The rocking seat of claim 1 including, the movement of said upright means as a child seated on said seat assembly shifts his weight forwardly and rearwardly and side to side defining a cone.

15. The rocking seat of claim 1 including, said body of resilient material directly supporting the entire weight of said seat assembly, a child seated on said seat assembly, said upright means, and said retaining means.

16. The rocking seat of claim 1 including, said upright means comprising a generally vertically disposed pole.

17. The rocking seat of claim 1 including, said retaining means including a horizontal base plate, said lower end of said upright means being secured directly to an upper surface of said horizontal base plate, and said horizontal base plate being secured directly to said upper flange.

* * * * *